United States Patent [19]

Ricke, Sr.

[11] 4,294,302

[45] * Oct. 13, 1981

[54] SHUTTER AND AWNING DEVICE

[75] Inventor: Cyril T. Ricke, Sr., Itasca, Ill.

[73] Assignee: Security Shutter Corp., Venice, Fla.

[ * ] Notice: The portion of the term of this patent subsequent to Aug. 13, 1993, has been disclaimed.

[21] Appl. No.: 178,038

[22] Filed: Aug. 14, 1980

Related U.S. Application Data

[63] Continuation of Ser. No. 528,482, Nov. 29, 1974, abandoned, which is a continuation of Ser. No. 313,563, Dec. 13, 1972, abandoned.

[51] Int. Cl.[3] ..... E06B 9/08

[52] U.S. Cl. ..... 160/133; 160/309

[58] Field of Search ..... 160/133, 235, 107, 183, 160/238, 309, 267

[56] References Cited

U.S. PATENT DOCUMENTS

| | | | |
|---|---|---|---|
| 1,147,188 | 7/1915 | Rojas | 160/309 X |
| 1,557,058 | 10/1925 | Johansen | 160/133 |

FOREIGN PATENT DOCUMENTS

| | | | |
|---|---|---|---|
| 103191 | 2/1938 | Australia | 160/267 |
| 271779 | 9/1968 | Austria | 160/267 |
| 609666 | 2/1935 | Fed. Rep. of Germany | 160/133 |
| 1237289 | 3/1967 | Fed. Rep. of Germany | 160/133 |
| 858361 | 5/1940 | France | 160/133 |
| 931702 | 11/1947 | France | 160/235 |
| 1168722 | 9/1958 | France | 160/235 |
| 1210518 | 9/1959 | France | 160/309 |
| 431673 | 3/1948 | Italy | 160/133 |
| 796502 | 6/1958 | United Kingdom | 160/133 |
| 1113655 | 5/1968 | United Kingdom | 160/133 |

*Primary Examiner*—Philip C. Kannan

*Attorney, Agent, or Firm*—Hauke and Patalidis

[57] ABSTRACT

A combined shutter and awning protective device for an opening in a wall such as a window, comprising a plurality of slats of uniform cross-section slidably received within one another and having a rotary member by means of which the shutter can be rolled upon the rotary member to provide for raising and lowering thereof. The device includes frame members which are pivotable whereby the device can be pivoted outwardly from a wall or the like to act as an awning. The device also includes frame sections secured to the wall which allows the device, in its non-pivoted position with the shutter fully lowered, to secure itself in position over the window or the like to act as a protective and security covering.

10 Claims, 11 Drawing Figures

SHUTTER AND AWNING DEVICE

This application is a continuation of application Ser. No. 528,482, filed Nov. 29, 1974 for *Shutter and Awning Device,* which in turn was a continuation of application Ser. No. 313,563, filed Dec. 13, 1972 now both abandoned.

SUMMARY OF THE INVENTION

The present invention is a security type shutter device which, though containing rigid members, can be rolled up on a roller. The device includes slats made from aluminum or other extrudable material of sufficient strength to protect the window or other access opening against damage from storms or vandalism. Each of the slats is of uniform cross-section whereby they can be made on a common extruding die and shaped so that they may be assembled by sliding one within another. The unique awning and shutter device of the present invention is slidably mounted within a pivotable framework whereby when the awning or shutter device is moved toward its lowered position it may be pivoted outwardly from the wall so as to act as an awning. Conveniently, the individual slats have a concave shape facing outwardly from the wall to add to the strength of the individual slats and further to prevent reflections from the sun which would be objectionable to people in the area of the protective device. In addition, the present device provides a means for conveniently raising and lowering the shutter or awning comprised of a rotary gear mechanism which may be manually operated.

DESCRIPTION OF THE PREFERRED EMBODIMENT

Figures 1, 2, 3, 4, 10:
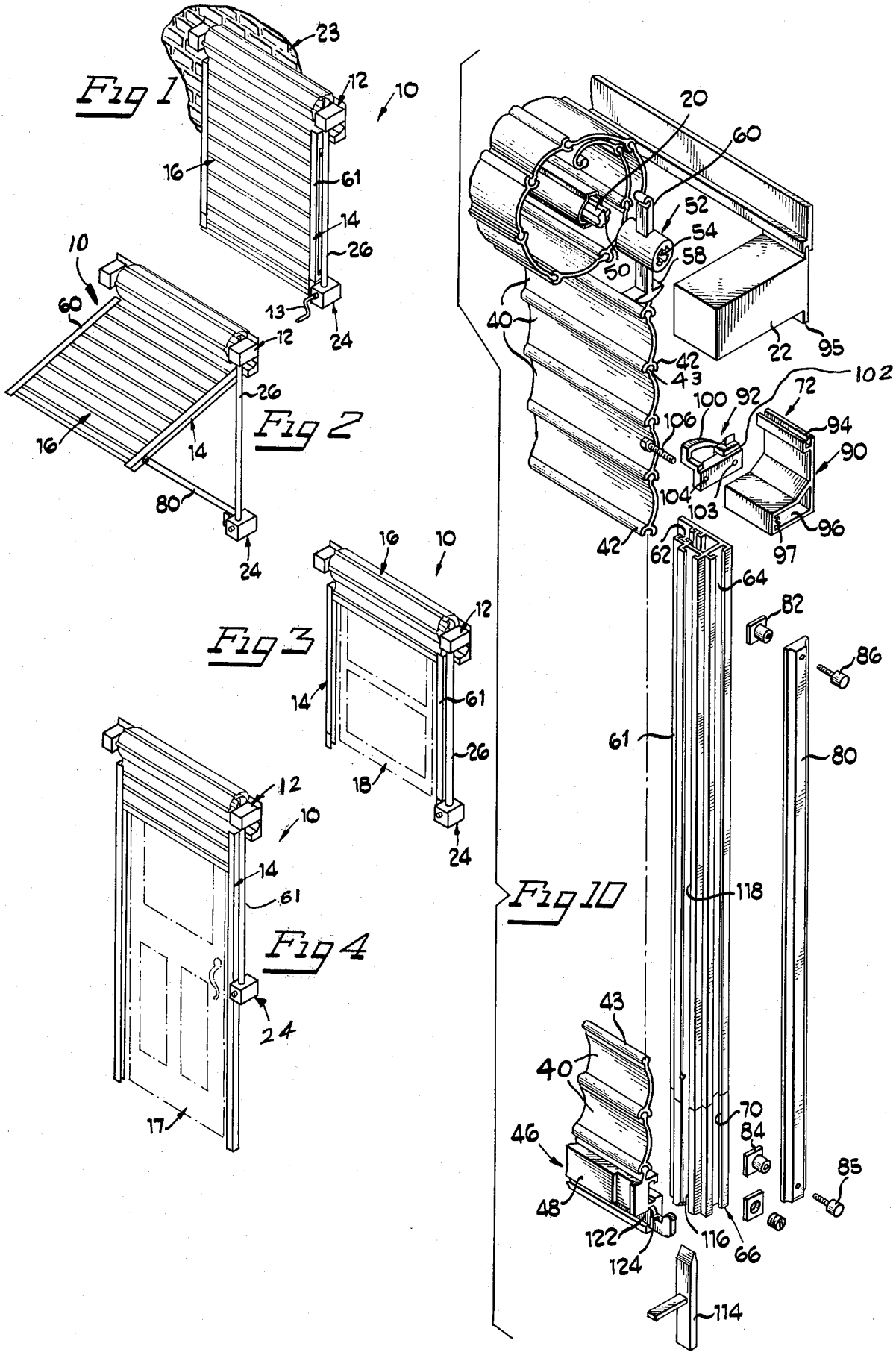
FIG. 1 is a perspective view of the shutter and awning device of the present invention with the device mounted over a window in its lowered position.
FIG. 2 is a schematic view as in FIG. 1 with the shutter and awning device in its pivoted or awning position.
FIG. 3 is a schematic view of the shutter and awning device in its retracted position.
FIG. 4 is a schematic view of the shutter and awning device as modified for use with a door.
FIG. 10 is a perspective exploded view of some of the frame members and other parts of the shutter and awning device of the present invention.

Referring to FIG. 1, the shutter and awning device 10 of the present invention is shown in schematic view and includes a rotary drive mechanism 12 operable by a preferably removably driving handle 13, frame mechanism 14 and a shutter mechanism 16. In FIG. 1, the device is shown with the awning or shutter in its lowered position with the slats engaged within the frame mechanism 14 and in a lowered position.

Referring to FIG. 2, a perspective view of the device 10 is again presented with the awning or shutter 16 in its pivoted or awning position. FIG. 3 is a similar schematic view in which the rotary drive mechanism 12 has been actuated to retract the shutter to provide access to the window 18.

Referring to FIG. 4, the device 10 is shown as adapted to act as a retractable protective shutter for a door. In this embodiment, no pivot mechanism is provided since the awning function of the device 10 is not desired.

Figure 5:
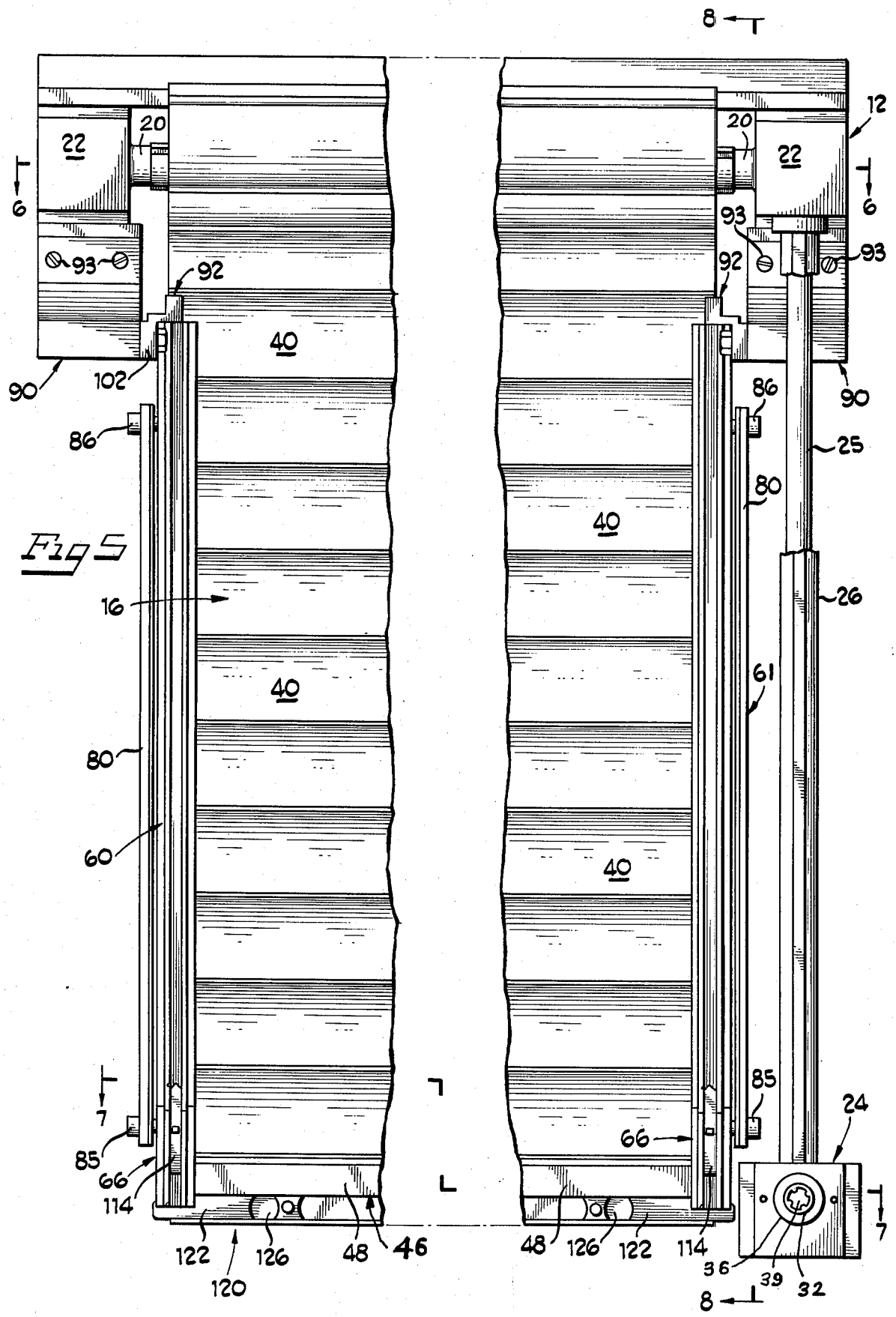
FIG. 5 is a rear elevation view of the awning and shutter device of the present invention.
Figures 6, 7, 8, 9, 11:
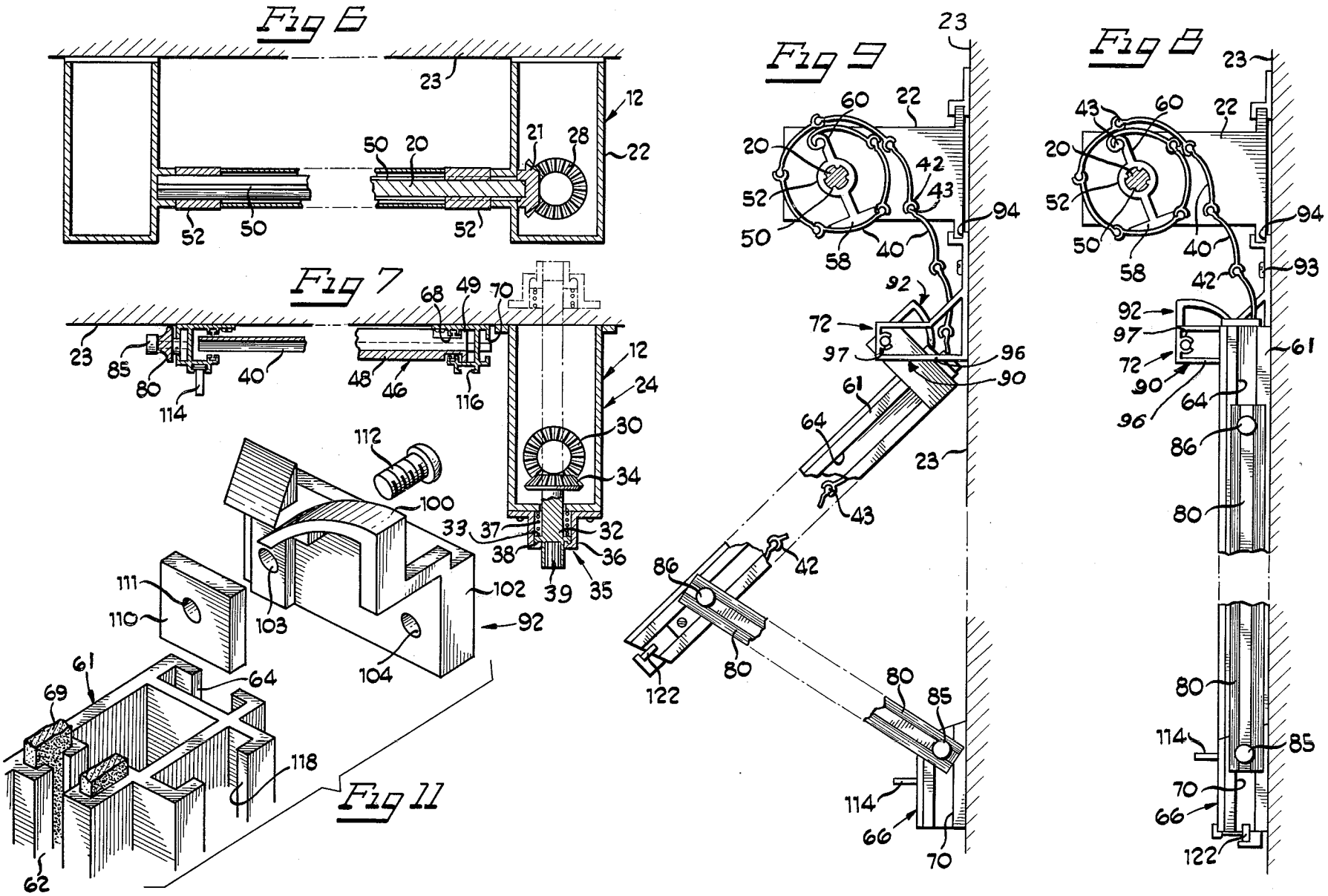
FIG. 6 is a sectional view taken along line 6—6 of FIG. 5.
FIG. 7 is a sectional view taken along line 7—7 of FIG. 5.
FIG. 8 is a sectional view taken along line 8—8 of FIG. 5.
FIG. 9 is a view similar to FIG. 8 with the device shown in its pivoted or awning position.
FIG. 11 is a perspective exploded view of the pivot mechanism for the awning device.

Referring to FIGS. 5, 6 and 7 the drive mechanism 12 for the shutter and awning device 10 includes a rotary shaft 20 having a bevel gear 21 at the right end thereof located in a gear box 22 secured to the wall 23 in which the window 18 is provided. An additional gear box 24 is mounted on wall 23 beneath box 22. A shaft 25 contained within a tube 26 extends between the gear box 24 and gear box 22 and has a bevel gear 28 on the upper end thereof meshing with bevel gear 21 on the shaft 20 and bevel gear 30 on the lower end thereof within gear box 24. Rotatably mounted in gear box 24 is a driving shaft 32 having a bevel gear 34 mounted thereon in meshing engagement with the bevel gear 30 on the lower end of shaft 25. By means of the driving mechanism 12 the awning or shutter device 16 may be rolled upon the shaft 20 to raise the awning or shutter by manual rotation of shaft 32. A lock mechanism 35 is provided including a cap member 36 secured to gear box 24 with a spring 37 therebetween. Mating locking teeth 38 are provided inside cap member 36 and on a shoulder portion 33 of shaft 32. Spring 37 urges the mating teeth into engagement to hold shaft 32 against rotation except when the driving handle 13 FIG. 1, (not illustrated) at FIG. 7 is pressed in a socket 39 in the end of the shaft 32 to displace the shaft 32 longitudinally against the pressure of the spring 37 to disengage teeth 38 and thus permit rotation of shaft 32 by the driving handle, the shaft 32 being longitudinally displaceable of a distance permitting the engagement of the teeth 38 and supporting bevel gear 34 by any convenient sliding means such as a spine and groove coupling, not shown.

Referring to FIGS. 5 and 10, the shutter mechanism 16 comprises a series of individual slats 40 of identical cross-section forming an articulated curtain. The slats 40 are shaped concavely in a direction outwardly from the wall 23 and are conveniently formed from an extrudable metal or other material such that individual slats may be economically manufactured. Each slat 40 has a socket portion 42 extending along one edge thereof and a rod portion 43 extending along the other edge thereof whereby individual slats can be assembled together by sliding the rod portion 43 of one slat into the socket portion 42 of the next to form a coupling between the slats. In this manner, the slats may pivot with respect to one another and are in a force transmitting relationship.

The bottom slat or rail 46 of the shutter mechanism 16 has a large bar 48 at the bottom thereof extending the length of the slat 46 which imparts strength to the mechanism when in its lowered position. Slat or rail 46 provides additional security against vandalism and storm damage and aids by virtue of its weight in the sliding movement of shutter mechanism 16 in frame mechanism 14. The edges of the slat or rail 46 are formed with T-shaped sections 49 (See FIG. 7) which are received within a groove in frame mechanism 14 on either side of the shutter 16.

The shaft 20 for retracting the shutter mechanism 16 has a series of splines 50 (See FIG. 10) formed thereon. A collar 52 having a bore 54 of complementary shape to that of splines 50 on the shaft 20 is assembled over the shaft 20 on either end thereof. Formed with the collar 52 is a driving lug having a lower portion 58 and an upper portion 60. The upper portion 60 is adapted to be received by rod 43 of the uppermost slat 40 whereby when the shaft 50 is rotated the first slat 40 will be moved about the axis of shaft 20 and due to the force transmitting relationship will pull up the other slats 40 to retract the shutter mechanism 16 and roll the shutter upon the shaft 20.

The frame mechanism 14 includes a side frame member 61 on either side of the device 10. Each of the side frame members 61 is made of an extrudable material such as aluminum or plastic and has a vertical slot or groove 62 formed on the inner edge thereof which is adapted to receive an end portion of bottom slat or rail 46 and forms a track for slats 40 to enable them to travel vertically. Also provided on the side frame members 61 is a groove 64. In addition, the frame mechanism 14 includes lower frame members 66 on either side thereof which are adapted to be secured to the wall 23. The members 66 have a slot or groove 68, FIG. 7 which is identical to slot 62 of the side frame members 61. Bottom slat or rail 46 is milled to be captured in but to be able to slide up and down within grooves 62 and 68. As shown in FIG. 11 a pair of felt strips 69 are provided on either side of the grooves 62 and 68 to provide a snug fit for the ends of the bottom slat or rail 46 to prevent rattle and noisy operation when the shutter device is raised or lowered.

Also provided in the lower frame members 66 is a groove or slot 70 which is complementary to the slot 64. Provided on the upper end of the frame member 61 is a pivoting mechanism 72 which permits pivotal movement of the side frame members 61 when the shutter mechanism 16 is in its partly lowered position as illustrated in FIG. 2 to act as an awning. A pair of guide arms 80 are provided on either side of the device 10 which have guide members 82 and 84, best shown at FIG. 10, secured thereto on the upper and lower ends respectively thereof. The guide member 84 is secured within the groove 70 in the lower frame member 66 by a screw 85 such that it will not slide with respect thereto. The upper guide member 82 is secured to the guide arm 80 by a screw 86 and is slidably received within the groove 64 in the side frame member 61 whereby when the awning or shutter mechanism 16 is pivoted outwardly as shown in FIG. 2 to act as an awning the guide arms 80 will pivot outwardly with the guide member 82 sliding within the slot or groove 64 and the lower end of the guide arm 80 pivoting about the fixed guide member 84. In this way the guide arms 80 act as supports for the shutter mechanism 16 when it is in its pivoted or awing position illustrated in FIG. 2.

Pivot mechanism 72 includes a stationary support member 90 and a pivot member 92. Support 90 is secured to wall 23 by screws 93 and has an upper groove 94 adapted to receive a lower portion 95 of gear box 22. Support 90 also includes a hollow portion 96 having a socket shaped threaded portion 97. Pivot member 92 has an arcuate portion 100 adapted to contact slats 40 when member 92 pivots and a mounting portion 102 having bores 103 and 104 therein. As best illustrated in FIG. 10 a threaded shoulder bolt 106 extends through bore 104 and into threaded socket portion 97 of support 90 thereby pivotally mounting pivot member 92 on support 90. Referring to FIG. 11 the frame members 61 are carried by pivot member 92 so that the frame members 61 may be pivoted. A block 110 is received in groove 64 and has a threaded bore 111 therein. A screw 112 extends through bore 103 and is received within bore 111 thereby securing pivot member 92 to frame member 61.

Also shown in FIG. 10 is a lock member 114 which may be received within a slot 116 of lower frame member 66. A matching slot 118 is provided in frame member 61 and when the frame member 61 is in its non-pivoted position and the lock 114 is slid to a position in engagement with both slots 116 and 118, the side frame members 61 are secured in their non-pivoted positions.

A latch mechanism 120 (See FIGS. 5 and 10) is provided and mounted within bar 48 which includes a pair of spring loaded latch members 122 having a groove 124 therein. Since the members 122 are spring loaded apart, when the shutter and awning is lowered to its lowered position as illustrated in FIG. 5, the members 122 will move apart and grooves 124 will engage the lower end of frame member 66 to hold the shutter and awning device in its lowered position. Finger cut-outs 126 are provided in each latch member 122 so that they can be retracted to enable raising or retracting of the device.

Referring to FIG. 7 an optional construction of shaft 32 is illustrated in phantom lines wherein the shaft 32 extends through wall 23 so that for security purposes the device 10 may be raised or lowered from inside the building.

From the above, it will be apparent that the present invention provides an economical combined shutter and awning device which will afford maximum security against storms and/or vandalism and at the same time provides the advantage of being usable as an awning in a pivoted position outwardly from the window. In addition, the individual slats 40 of the shutter mechanism 16 are of common cross-section such that they can be manufactured by extruding process through a common extruding die and the shape thereof affording a force transmitting relationship between each of the slats along the entire length thereof such that the force transmitting relationship is sufficiently strong to withstand damage and at the same time to afford the force transmitting relationship necessary when the shutter mechanism 16 is moved to its retracted position illustrated in FIG. 3.

Various features of the invention have been particularly shown and described, however, it should be obvious to one skilled in the art that various modifications may be made therein without departing from the scope of the invention.

What is claimed is:

1. A protective shutter device for an opening in a wall or the like comprising an articulated curtain made of a plurality of identical interlocked elongated rigid slats each assembled hingedly relative to an adjoining slat and each having a rod-like integral projection extending along an edge thereof and a socket-like integral portion extending along the other edge thereof whereby said plurality of slats are assembled together by sliding the rod-like projection along an edge of a slat through the socket-like edge portion of another slat, a pair of guide frame members each mounted on one side of said articulated curtain and having a groove slidably receiving an end of each of said slats, and a drive mechanism for raising and lowering said articulated curtain, said drive mechanism comprising a shaft having an axis of rotation disposed substantially parallel to the longitudinal axis of said slats, means rotatably supporting said shaft at the top of said opening, at least a pair of lugs mounted on said shaft and extending radially from said shaft, means attaching one of said slats disposed at an end of said articulated curtain to one of said lugs whereby rotation of said shaft in one direction causes said articulated curtain to be raised and said slats to be wound around said shaft in spaced apart relationship from said shaft, gear drive means driving said shaft in said one direction for raising said articulated curtain and in an opposite direction for lowering said articulated curtain, and gear drive locking means for controllably locking said gear drive means against rotation when not in operation for raising and lowering said articulated curtain.

2. The protective shutter of claim 1 wherein said gear drive locking means comprises a gear box, a drive shaft journalled in said gear box, a first bevel gear mounted on said drive shaft, a second bevel gear meshing with said first bevel gear, means coupling said second bevel gear to said first mentioned shaft, mating locking teeth on said drive shaft and in said gear box for holding said drive shaft against rotation, and means for disengaging said mating teeth for permitting rotation of said drive shaft.

3. The protective shutter device of claim 2 wherein an end of said drive shaft has means for coupling with a driving handle.

4. The protective shutter device of claim 2 wherein said means coupling said second bevel gear to said first mentioned shaft comprises an intermediary shaft having said second bevel gear mounted on one end thereof, a third bevel gear mounted on the other end of said intermediary shaft and a fourth bevel gear mounted on an end of said first mentioned shaft, said fourth bevel gear meshing with said third bevel gear.

5. The protective shutter device of claim 4 wherein said third and fourth bevel gears are disposed in a second gear box, each of said third and fourth bevel gears is mounted on a stub shaft journaled in said gear box, and said intermediary shaft is coupled to one of said stub shafts by means of a spline coupling arrangement.

6. The protective shutter device of claim 1 further comprising a bar member hingedly attached to the slat disposed at the other end of said articulated curtain, a T-shaped end portion at each lateral end of said bar member, and a T-shaped groove in each of said side frame members for slidably receiving one said T-shaped end portion of said bar member.

7. The protective shutter device of claim 6 further comprising locking means in said bar member having a reciprocable tongue member engageable in a corresponding recess in each of said side frame members for locking said articulated curtain in an extreme lowered position.

8. The protective shutter device of claim 1 wherein each of said side frame members is formed of two separate normally aligned upper and lower sections and further comprising pivot means supporting the upper end of said upper section, locking means at the lower end of said upper section for locking said lower end in alignment with said lower section, and a guide arm for each of said side frame members, said guide arm having one end pivotably mounted to said lower portion and another end slidably attached to said upper portion for maintaining said upper portion in any one of a plurality of angled positions.

9. The protective shutter device of claim 1 wherein said slats are made of lengths of extruded metallic material.

10. The protective shutter device of claim 9 wherein said slats have each a uniform cross-section and are shaped as a section of a cylinder.

* * * * *